United States Patent [19]

Braxter, Sr.

[11] 4,422,205

[45] Dec. 27, 1983

[54] BATHING APPLIANCE

[76] Inventor: Lorenzo C. Braxter, Sr., 502 First Ave., Selma, Ala. 36701

[21] Appl. No.: 340,831

[22] Filed: Jan. 19, 1982

Related U.S. Application Data

[63] Continuation-in-part of Ser. No. 943,703, Oct. 10, 1978, abandoned.

[51] Int. Cl.[3] ..... A47K 7/03

[52] U.S. Cl. ..... 15/222; 15/210 R

[58] Field of Search ..... 15/209 R, 210 R, 222, 15/104.94, 208, 244 R, 244 B; 128/62 R, 63; D28/63

[56] References Cited

U.S. PATENT DOCUMENTS

| | | | |
|---|---|---|---|
| 506,869 | 10/1893 | Boardman | 15/222 |
| 1,345,026 | 6/1920 | Riley | 15/222 X |
| 1,820,256 | 8/1931 | Stewart | 15/244 B |
| 3,048,938 | 8/1962 | Mears | 15/209 R |
| 3,144,671 | 8/1964 | Gould et al. | 15/208 X |
| 3,638,270 | 2/1972 | Schlegel et al. | 15/244 B X |
| 3,860,349 | 1/1975 | Scott | 15/222 X |

FOREIGN PATENT DOCUMENTS

| | | | |
|---|---|---|---|
| 504234 | 7/1954 | Canada | 15/222 |
| 650148 | 9/1928 | France | 15/208 |
| 1228894 | 3/1960 | France | 15/222 |
| 185 | of 1912 | United Kingdom | 15/222 |
| 1079672 | 8/1967 | United Kingdom | 15/222 |

*Primary Examiner*—Edward L. Roberts

*Attorney, Agent, or Firm*—Harvey B. Jacobson

[57] ABSTRACT

An elongated flexible strip is provided having at least one side thereof defining a rough scrubbing surface and the aformentioned one side includes a transversely extending convexly rounded hump centrally intermediate the opposite ends of the one side. The strip includes a pair of thin opposite side panels of flexible material and a central thicker panel of flexible resilient material sandwiched between the opposite side thin panels. The thin panels include registered side marginal edges and end marginal edges sewn together whereby to encase the central thicker panel fully within the confines of the thin panels. The transversely extending and convexly rounded hump is defined by a transversely rounded body of resilient material disposed between the thin panel defining the rough scrubbing surface and the adjacent side of the thicker panel. The thin panels are sewn together through the thicker panel along transverse zones of the strip extending along and disposed on opposite sides of the rounded body.

9 Claims, 10 Drawing Figures

BATHING APPLIANCE

CROSS-REFERENCE TO RELATED APPLICATION

This application comprises a continuation-in-part of my co-pending U.S. Ser. No. 943,703, filed Oct. 10, 1978, now abandoned, for Calculated Improved Bathing Back Towel.

BACKGROUND OF THE INVENTION

It is difficult for persons having physical disabilities to thoroughly clean the surfaces of their backs when bathing. Although bathing brushes are available for scrubbing a bather's back, these bathing brushes must be used either with the hand holding the handle of the brush disposed behind the small of the back or in back of the neck. As a result, many disabled persons may not use back brushes inasmuch as they are unable to move their arms and hands into positions which enable a back brush to be used. Still further, some persons having little or no physical disablement of their hands or arms tend to lose their balance when their arms and hands are positioned for use of a back brush.

Accordingly, a need exists for an improved appliance which may be used effectively by even severely disabled persons to perform a scrubbing action on their backs when bathing.

Examples of back scrubbing devices, including some of the general structural and operational features of the instant invention are disclosed in U.S. Pat. Nos. 506,869, 1,345,026, 1,820,256, 3,048,938, 3,114,671 and 3,638,270, as well as Canadian Pat. No. 504,234, French Pat. Nos. 560,148 and 1,228,894 and Great Britain Pat. Nos. 185 and 1,079,672.

BRIEF DESCRIPTION OF THE INVENTION

The back scrubbing appliance of the instant invention comprises an elongated flexible strip having at least one side thereof defining a rough scrubbing surface and with that one side of the strip including a transversely extending convexly rounded hump centrally intermediate its opposite ends. The strip is constructed of a pair of thin opposite side panels of flexible material and a central thicker panel of flexible resilient material sandwiched between the opposite side panels. The thin opposite side panels include registered side and end marginal edges which are sewn together to encase the central thicker panel fully within the confines of the thin panels and the side of the stip opposite the side thereof defining the rough scrubbing surface may also define a rough scrubbing surface.

The main object of this invention is to provide an appliance which will enable a bathing person to fully scrub his entire back surface, including the central vertically extending depression registered with the spinal column.

Another object of this invention is to provide an appliance which may be further utilized to massage, rub or scratch the entire back surface of the user.

Yet another object of this invention is to provide an appliance which may be utilized by even disabled persons to accomplish the aforementioned functions.

A final object of this invention to be specifically enumerated herein is to provide an appliance in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
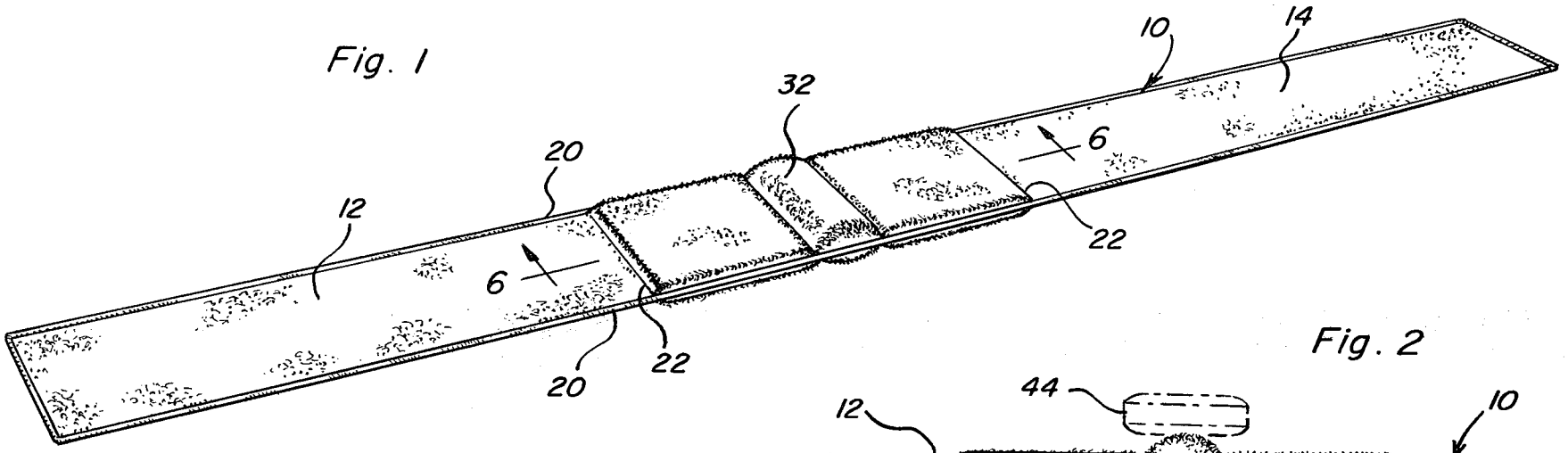
FIG. 1 is a perspective view of the appliance.

Referring now more specifically to the drawings, the numeral 10 generally designates the appliance of the instant invention. It may best be seen from FIG. 1 of the drawings that the appliance 10 comprises an elongated strip 12 and from FIG. 2 of the drawings that the strip 12 is defined by a pair of thin opposite side panels 14 and 16 which may be constructed of various materials such as soft cotton knit, terry cloth, Jacquards' weave, polyurethane foam, foam rubber or a spongy absorbent and scratchy or rough material. However, the thin opposite side panels 14 and 16 are preferably constructed of terry cloth or a similar material.

The thin opposite side panels 14 and 16 include registered opposite side and longitudinal marginal portions which are sewn together as at 20 and 22, respectively. The panel 14 is longer than the panel 16 and the opposite ends of the panel 16 extend only slightly beyond the opposite ends of the panel 18.

Figure 10:
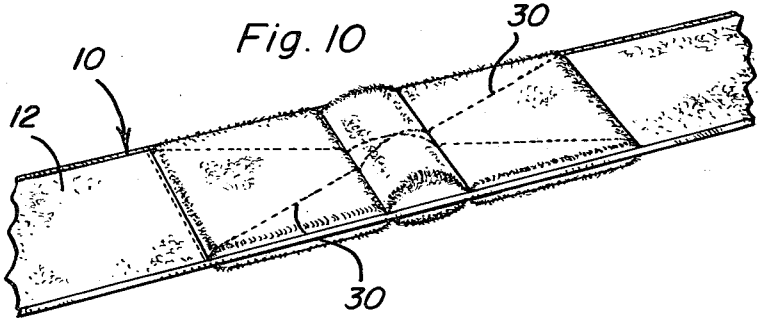
FIG. 10 is a fragmentary perspective view of the central portion of the appliance illustrating additional cross-stitching in the area thereof occupied by the central thicker panel of flexible and resilient material.

The central portion of the strip 12 has a transversely extending elongated body 24 of flexible and resilient material such as foam rubber interposed between the longitudinal midportion of the panel 14 and the opposing midportion of the panel 18. In addition, the panels 14 and 16 are sewn together, through the panel 18 as at 26, along zones extending along opposite sides of the body 24. In this manner, not only the panel 18, but also the body 24, is fully encased within the confines of the panels 14 and 16. If it is desired, the longitudinal edges of the panels 14 and 16 may be secured together by loop stitching. Further, conventional stitching 30 may be used to secure the panels 14 and 16 together through not only the panel 18 but also the body 24, see FIG. 10, along diagonally crossed zones extending between opposite longitudinal corners of the panel 18. Further, the panels 14 and 16 may be of the same length.

Figure 6:
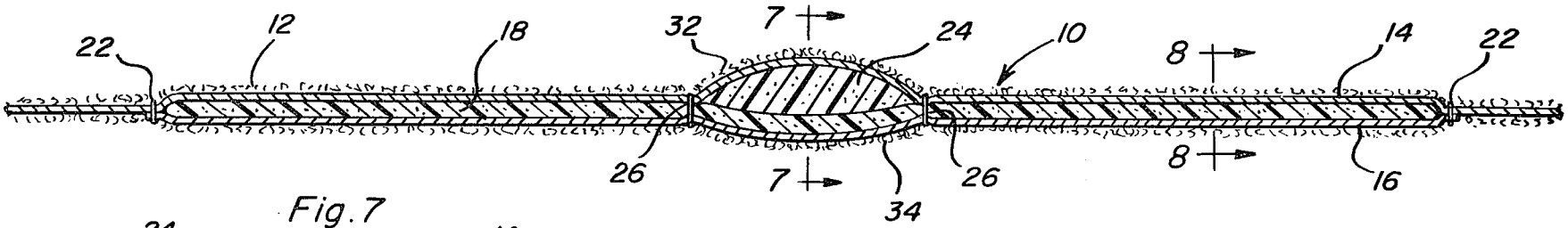
FIG. 6 is an enlarged fragmentary longitudinal vertical sectional view taken substantially upon the plane indicated by the section line 6—6 of FIG. 1.
Figure 9:
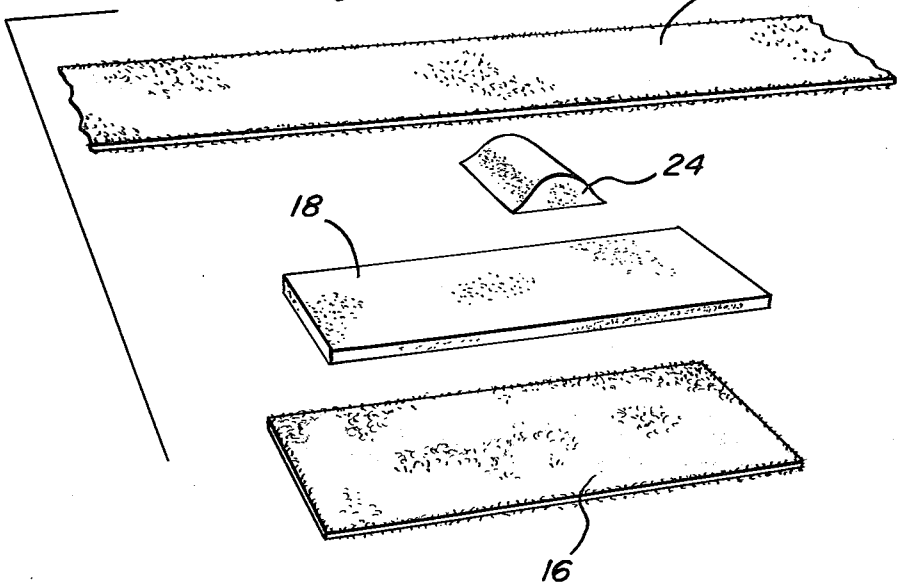
FIG. 9 is an exploded perspective view of the various components comprising the appliance prior to the thin opposite side panels thereof being sewn together.
Figure 7:
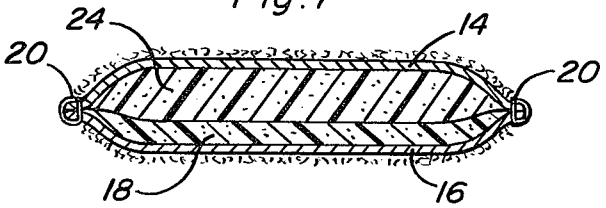
FIG. 7 is a transverse sectional view taken substantially upon the plane indicated by the section line 7—7 of FIG. 6.
Figure 8:
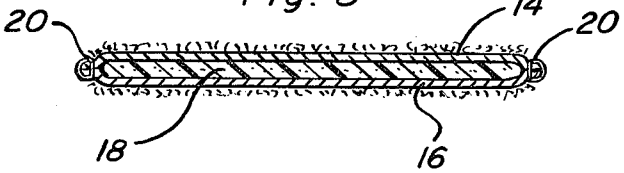
FIG. 8 is a transverse sectional view taken substantially upon the plane indicated by the section line 8—8 of FIG. 6.

While the terry cloth of which the panels 14 and 16 are preferably formed may have equal roughness on the remote sides of the panels 14 and 16, the remote sides of the panels 14 and 16 may be rough and smooth, respectively. Further, it will be noted from FIG. 6 of the drawings that the body 24 defines a first hump 32 extending transversely of the longitudinal midportion of the strip 12 and that the hump 32 is transversely convexly arcuate. Also, inasmuch as the body 24 also slightly outwardly deflects the panel 18 to the opposite side of the strip as well as the portion of the panel 16 extending over that side of the panel 18, a smaller hump 34 is defined on the side of the strip defined by the panel 16.

Figure 3:
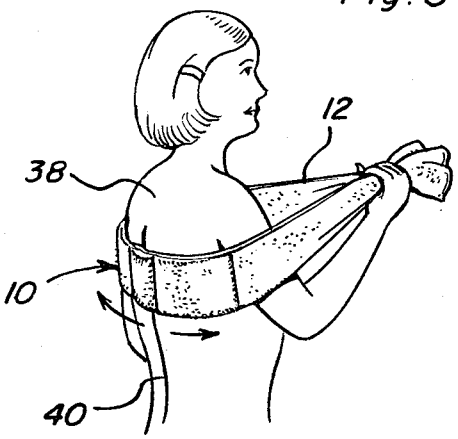
FIG. 3 is a perspective view of the appliance in use by a one-armed person.

With attention now invited more specifically to FIG. 3 of the drawings, it may be seen that a one-armed user 38 may readily use the appliance 10 to scrub her back and that the hump 32 will enable even the central vertically extending depression in her back registered with her spinal column to be scrubbed by the appliance 10.

Figure 4:
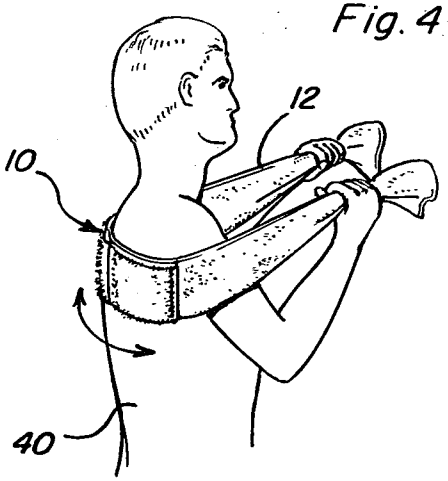
FIG. 4 is a perspective view illustrating the manner in which a two-armed person may use the appliance to scrub his upper back area.

With attention now invited to FIG. 4 of the drawings, it may be seen that the appliance 10 may be used by a two-handed person 40 in a more conventional manner, even though the two-handed person 40 may have minimal usage of his arms.

Figure 5:
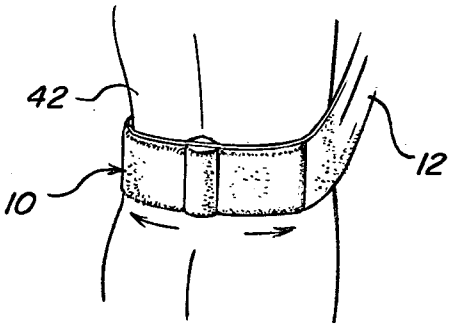
FIG. 5 is a perspective view illustrating the manner in which the lower back portion of the user may be scrubbed by the appliance.

With attention now invited to FIG. 5 of the drawings, it may be seen that the appliacne 10 may further be used even to scrub the lower portion of the back of the user 42 either in the manner illustrated in FIG. 3 of the drawings by a one-handed user of the appliance 10 or in the manner illustrated in FIG. 4 of the drawings by a two-handed user of the appliance 10.

Figure 2:
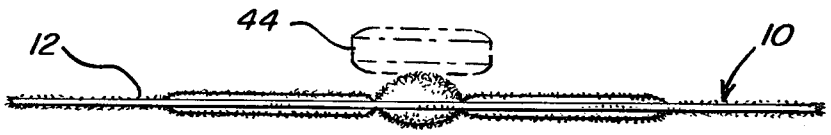
FIG. 2 is a side elevational view of the appliance on somewhat of a reduced scale and with the opposite end portions of the appliance being broken away.

FIG. 2 of the drawings illustrates the manner in which a bar 44 of soap initially may be used to apply soap to the appliance 10, after the latter has been dampened. Then, the side of the appliance 10 to which soap has been applied is used to scrub the user's back in either of the manners illustrated in FIGS. 3, 4 and 5.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A bathing appliance for washing and scrubbing the user's back and enabling thorough cleansing of the central depressed vertically extending area of the back registered with the user's spinal column, said appliance including an elongated flexible strip having at least one side thereof defining a rough scrubbing surface, said one side including a transversely extending, convexly rounded hump centrally intermediate its opposite ends, said strip including a pair of thin opposite side panels of flexible material and a central thicker panel of resilient material sandwiched between said opposite side panels.

2. The appliance of claim 1 wherein said thin panels include registered side and end marginal edges sewn together whereby to encase said central thicker panel fully within the confines of said thin panels.

3. The appliance of claim 1 wherein said hump is defined by a transversely rounded body of resilient material disposed between the thin panel defining the first mentioned scrubbing surface and the adjacent side of said thicker panel.

4. The assembly of claim 3 wherein said thin panels are sewn together through said thicker panel along transverse zones of the strip disposed on opposite sides of said rounded body.

5. The appliance of claim 1 wherein said hump constitutes the sole hump projecting outwardly of said one side of said strip and said hump is continuously convexly rounded.

6. A bathing appliance for washing and scrubbing the user's back and enabling thorough cleansing of the central depressed vertically extending area of the back registered with the user's spinal column, said appliance including an elongated flexible strip having at least one side thereof defining a rough scrubbing surface, said one side including a transversely extending, convexly rounded hump centrally intermediate its opposite ends, the other side of said strip also defining a scrubbing surface and including a transversely convexly rounded hump of lesser extent than the first mentioned hump, said strip including a pair of thin opposite side panels of flexible material and a central thicker panel of flexible resilient material sandwiched between said opposite side panels.

7. The appliance of claim 6 wherein said hump is defined by a transversely rounded body of resilient material disposed between the thin panel defining the first mentioned scrubbing surface and the adjacent side of said thicker panel.

8. The appliance of claim 7 wherein said thin panels are sewn together through said thicker panels along transverse zones of the strip disposed on opposite sides of said rounded body.

9. The appliance of claim 8 wherein said thin panels include registered side and end marginal edges sewn together whereby to encase said central thicker panel fully within the confines of said thin panels.

* * * * *